US008464560B2

(12) United States Patent
Kim et al.

(10) Patent No.: US 8,464,560 B2
(45) Date of Patent: Jun. 18, 2013

(54) WASHING MACHINE AND WASHING METHOD

(75) Inventors: Woo Young Kim, Seoul (KR); Soo Young Oh, Seoul (KR); Chang Oh Kim, Seoul (KR); Kyeong Hwan Kim, Seoul (KR); Jae Won Chang, Seoul (KR); Kyung Chul Woo, Seoul (KR); Byung Keol Choi, Seoul (KR); Myong Hun Im, Seoul (KR)

(73) Assignee: LG Electronics Inc., Seoul (KR)

( * ) Notice: Subject to any disclaimer, the term of this patent is extended or adjusted under 35 U.S.C. 154(b) by 535 days.

(21) Appl. No.: 12/704,923

(22) Filed: Feb. 12, 2010

(65) Prior Publication Data

US 2010/0205753 A1 Aug. 19, 2010

(30) Foreign Application Priority Data

Feb. 16, 2009 (KR) ..... 10-2009-0012520
Aug. 4, 2009 (KR) ..... 10-2009-0071696

(51) Int. Cl.
*B08B 3/12* (2006.01)
*D06F 37/00* (2006.01)

(52) U.S. Cl.
USPC ..... 68/3 R

(58) Field of Classification Search
USPC ..... 68/3 R
See application file for complete search history.

(56) References Cited

U.S. PATENT DOCUMENTS

| | | | | |
|---|---|---|---|---|
| 5,150,588 | A | 9/1992 | Singh et al. | |
| 5,307,651 | A | 5/1994 | Felzer | |
| 2006/0191078 | A1 * | 8/2006 | Kim et al. | 8/159 |

FOREIGN PATENT DOCUMENTS

| | | |
|---|---|---|
| EP | 1 696 066 | 8/2006 |
| JP | 2006-239141 | 9/2006 |
| JP | 2007-054416 | 3/2007 |
| JP | 2008-073128 | 4/2008 |
| JP | 2008-289681 | 12/2008 |
| KR | 10-2004-0092181 | 11/2004 |
| KR | 10-2007-0064001 | 6/2007 |
| RU | 2307205 | 9/2007 |
| UA | 100209 C2 | 11/2012 |

OTHER PUBLICATIONS

Russian Office Action issued in Russian Application No. 2011138012 dated Jun. 25, 2012 (full Russian text and full English translation).
International Search Report issued in PCT/KR2009/005469 dated May 14, 2010.
Japanese Office Action issued in Japanese Appln. No. 2011-550045 dated Jan. 8, 2013.
Ukrainian Office Action issued in Ukrainian Appln. No. 2011 11057 dated Jan. 18, 2013.
European Search Report issued in EP Application No. 09840092.2 dated Mar. 12, 2013.
European Search Report issued in EP Application No. 13150985.3 dated Mar. 25, 2013.

* cited by examiner

*Primary Examiner* — Michael Barr
*Assistant Examiner* — Jason Ko
(74) *Attorney, Agent, or Firm* — KED & Associates, LLP

(57) ABSTRACT

A washing machine and associated washing method are provided. The washing machine may include a cabinet, a drum rotatably installed in the cabinet, and a spray nozzle provided inside the cabinet to spray washing fluid into the drum. A spraying direction of the spray nozzle may be varied based on a rotation direction of the drum to improve washing performance of the washing machine.

11 Claims, 19 Drawing Sheets

WASHING MACHINE AND WASHING METHOD

This claims priority to Korean Application No. 10-2009-0012520, filed in Korea on Feb. 16, 2009, and Korean Application No. 10-2009-0071696, filed in Korea on Aug. 4, 2009, the entirety of which are hereby incorporated herein by reference.

BACKGROUND

1. Field

A washing machine and an associated washing method are provided, and more particularly, a washing machine and an associated washing method are provided in which washing water is sprayed into a drum.

2. Background

Generally, a washing machine is an apparatus for washing and/or drying laundry. A washing machine may wash laundry by effectively using washing fluid.

BRIEF DESCRIPTION OF THE DRAWINGS

The embodiments will be described in detail with reference to the following drawings in which like reference numerals refer to like elements wherein.

DETAILED DESCRIPTION

Hereinafter, the description of a laundry treatment operation of a washing machine as embodied and broadly described herein will be focused on a laundry washing cycle, simply for ease of explanation. However, it is well understood that a washing machine as embodied and broadly described herein is not limited to the following description, but encompasses all situations in which washing fluid is sprayed and soaked into laundry in the laundry treatment operation of such a washing machine, such as, for example, a cycle for rinsing laundry with washing water containing no detergent, a cycle for dehydrating laundry, and a cycle for dehydrating laundry by dry air, as well as the cycle for washing laundry.

Figure 1:
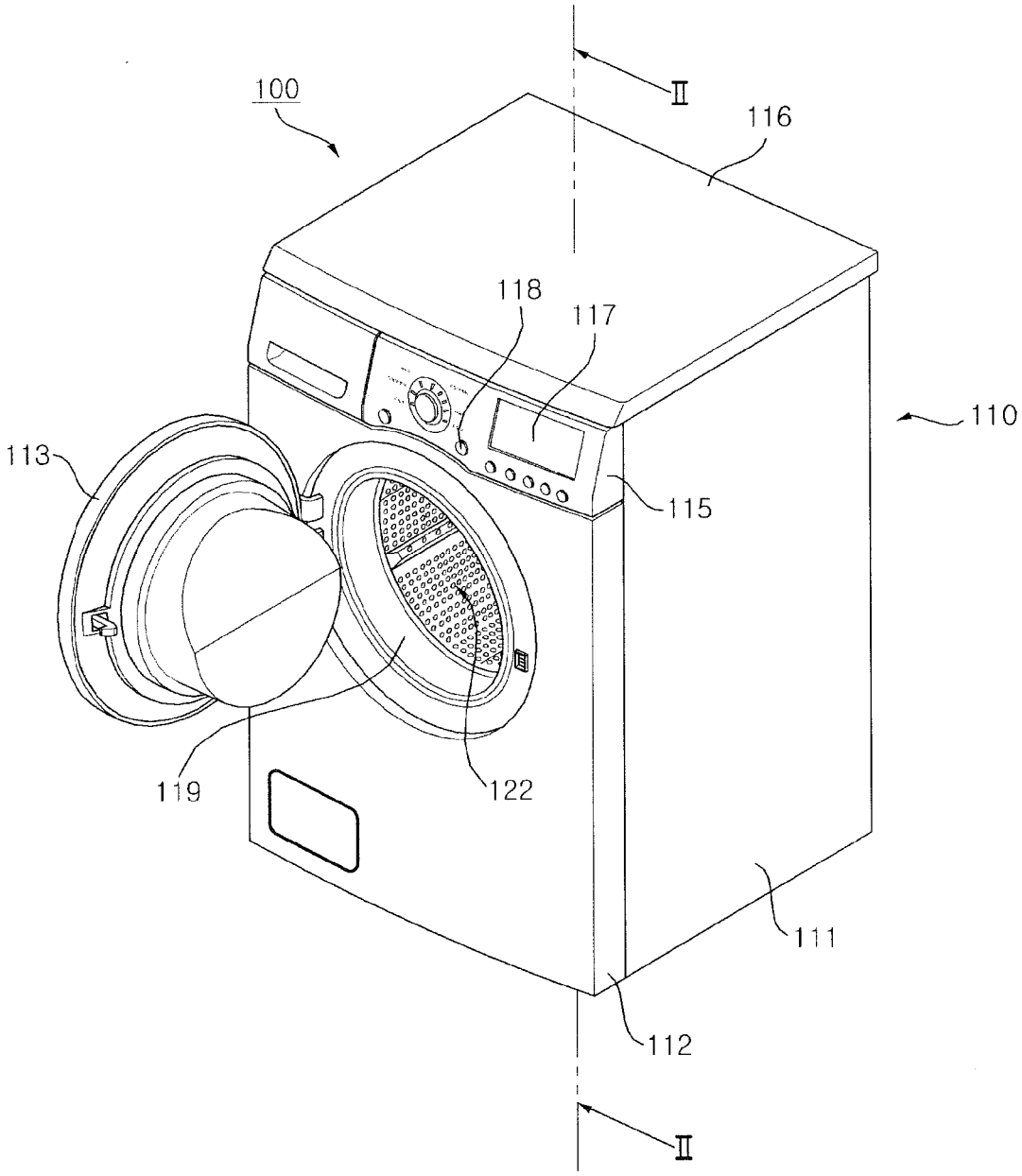
FIG. 1 is a perspective view of an exemplary washing machine in accordance with an embodiment as broadly described herein.
Figure 2:
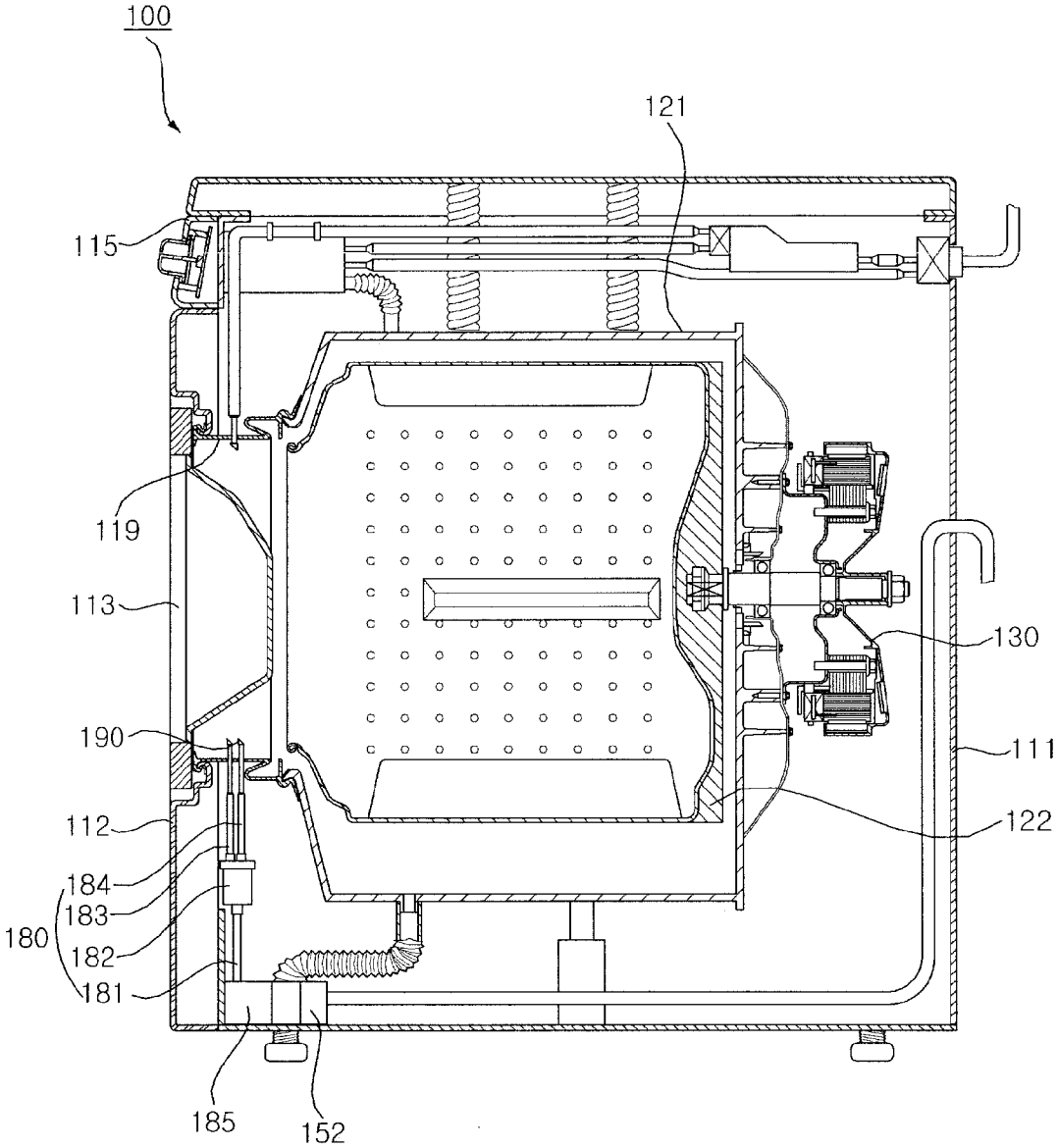
FIG. 2 is a cross-sectional view taken along line II-II of FIG. 1.

Referring to FIGS. 1 to 2, a washing machine 100 as embodied and broadly described herein may include a cabinet 110 having an opening, a tub 121 disposed inside the cabinet 110 to store washing fluid supplied by an external source, a drum 122 disposed inside the tub 121 to receive laundry, a driver 130 that supplies a driving force to the drum 122, a washing fluid supply device 125 for supplying washing fluid from an external source, and a draining device 150 for discharging the washing fluid in the drum 122 to the outside.

The washing machine 100 may also include an output device for informing a user on the outside of operation and control information. The output device may include, for example, an audible output device, either alone or in combination with visual output device, such as, for example, a display 117, for informing the user.

The cabinet 110 may include a cabinet main body 111, a cover 112 disposed on a front surface of the cabinet main body 111 and having an opening portion, a top plate 116 disposed on an upper side of the cover 112 and coupled to the cabinet main body 111, and a control panel 115 disposed at one side of the top plate 115 and coupled to the cabinet main body 111. A door 113 may be rotatably coupled to the cover 112 so as to open and close the opening portion, and a gasket 119 may be coupled to one side of the cover 112 and fixed to the other side of the tub 121 at the opening portion to prevent washing fluid from flowing into the tub 121.

The washing machine 100 may also include one or more spray nozzles 190 disposed inside the cabinet 110 to spray washing fluid into the drum 122, and a direction changing unit 180 that varies a spraying direction of the washing fluid sprayed from the spray nozzle 190 into the drum 122.

A plurality of spray nozzles 190 may be provided, including, for example, a first spray nozzle 191 disposed on the gasket 119 for spraying washing fluid in a first direction and a second spray nozzle 192 disposed on the gasket 119 for spraying washing fluid in a second direction that is different from that of the first spray nozzle 191. The first spray nozzle 191 and the second spray nozzle 192 may be positioned at different predetermined angles so as to spray washing fluid in different directions.

Figure 3:
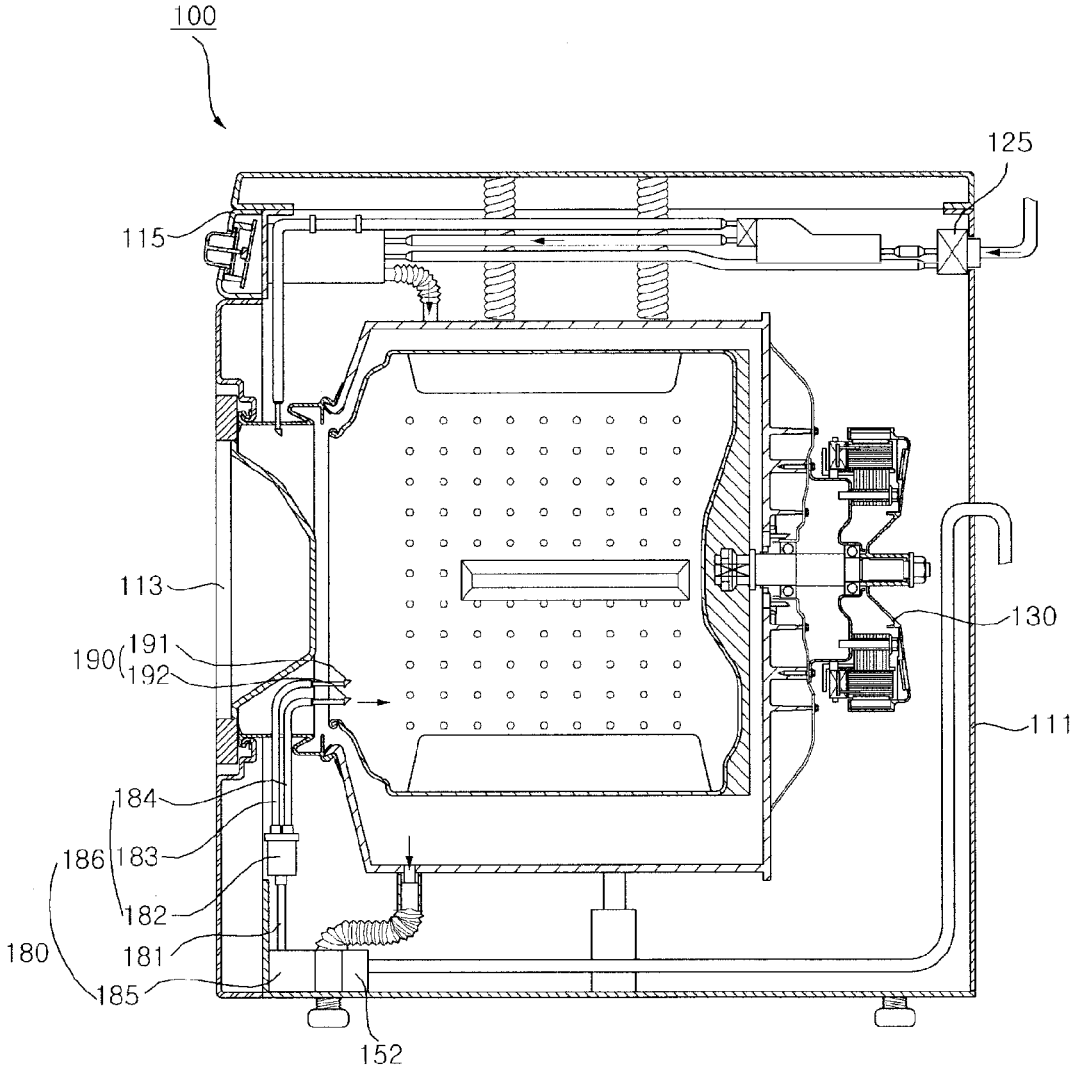
FIG. 3 illustrates the circulation and spraying of washing fluid in the washing machine shown in FIG. 1.

Referring to FIGS. 3 to 4, laundry items A may be placed in the drum 122 before operating the washing machine 100, and then washing fluid may be introduced into the drum 122 and the tub 121 from an external source. As the washing fluid is introduced, the drum 122 may rotate, either simultaneously with the introduction of the washing fluid or after the washing fluid reaches a predetermined level. Simply for ease of explanation, a case in which the drum 122 rotates after the washing fluid reaches a predetermined level will be described. However, the washing machine 100 as embodied and broadly described herein is not limited to the above case, and the drum 122 may be operated in various manners.

When the drum 122 rotates, the laundry items A received in the drum 122 rotate along with the drum 122. At this time, a hydraulic pressure varying unit may be is operated to circulate the washing fluid stored in the tub 121. The hydraulic pressure varying unit may include, for example, a circulation pump 185 that circulates the washing fluid from the tub 121. When the circulation pump 185 operates, the washing fluid flows through a supply path 181 that guides the washing fluid stored in the tub 121 to the circulation pump 185, with one side coupled to the tub 121. The washing fluid flowing through the supply path 181 may be dispensed by a direction changer 186.

Figure 4A:
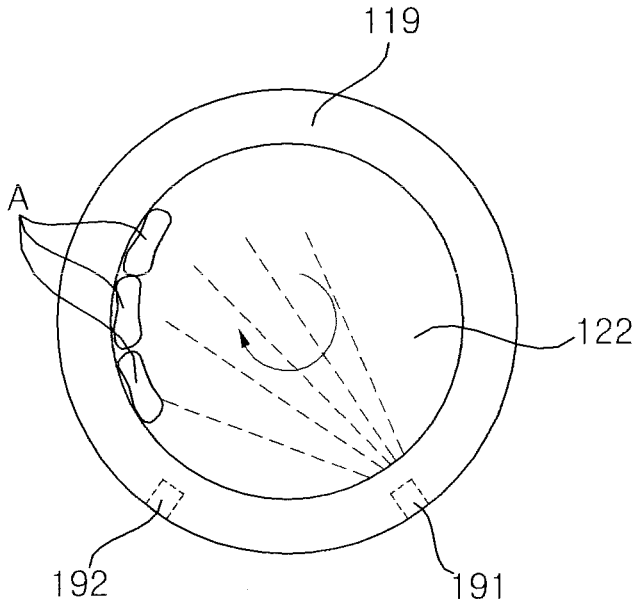
FIG. 4A illustrates the spray direction of washing fluid during clockwise rotation of the drum shown in FIG. 3.
Figure 4B:
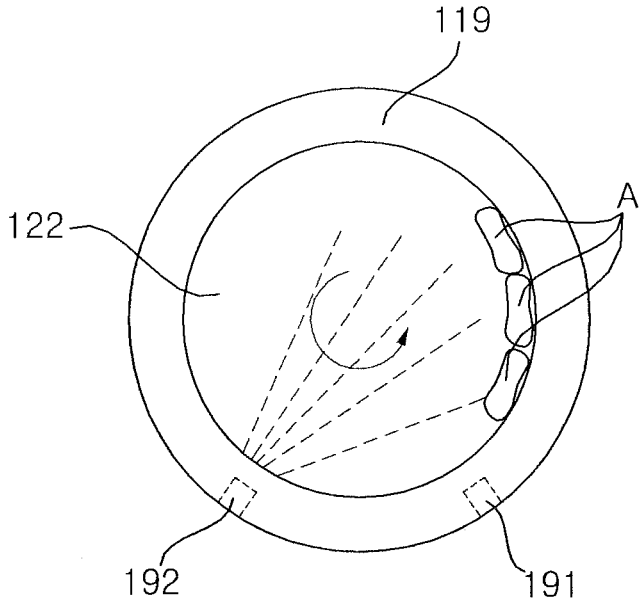
FIG. 4B illustrates the spray direction of washing fluid during counterclockwise rotation of the drum shown in FIG. 3.

The washing fluid dispensed by the direction changer 186 may be distributed to a plurality of guide passages 183 and 184 that guide the washing fluid to the spray nozzles 190. The washing fluid provided to the spray nozzles 190 is sprayed into the drum 122 based on a rotating direction of the drum 122 by the operation of the circulation pump 185. The spraying direction of the washing fluid sprayed into the drum 122 may also be varied based on the rotating direction of the drum 122. For example, as shown in FIG. 4A, when the drum 122 rotates clockwise, the washing fluid may be sprayed from the first spray nozzle 191 in a first direction. As shown in FIG. 4B, when the drum 122 rotates counterclockwise, the washing fluid may be sprayed from the second spray nozzle 192 in a second direction.

A method and apparatus for spraying washing water will be described hereinafter in more detail.

Figure 5:
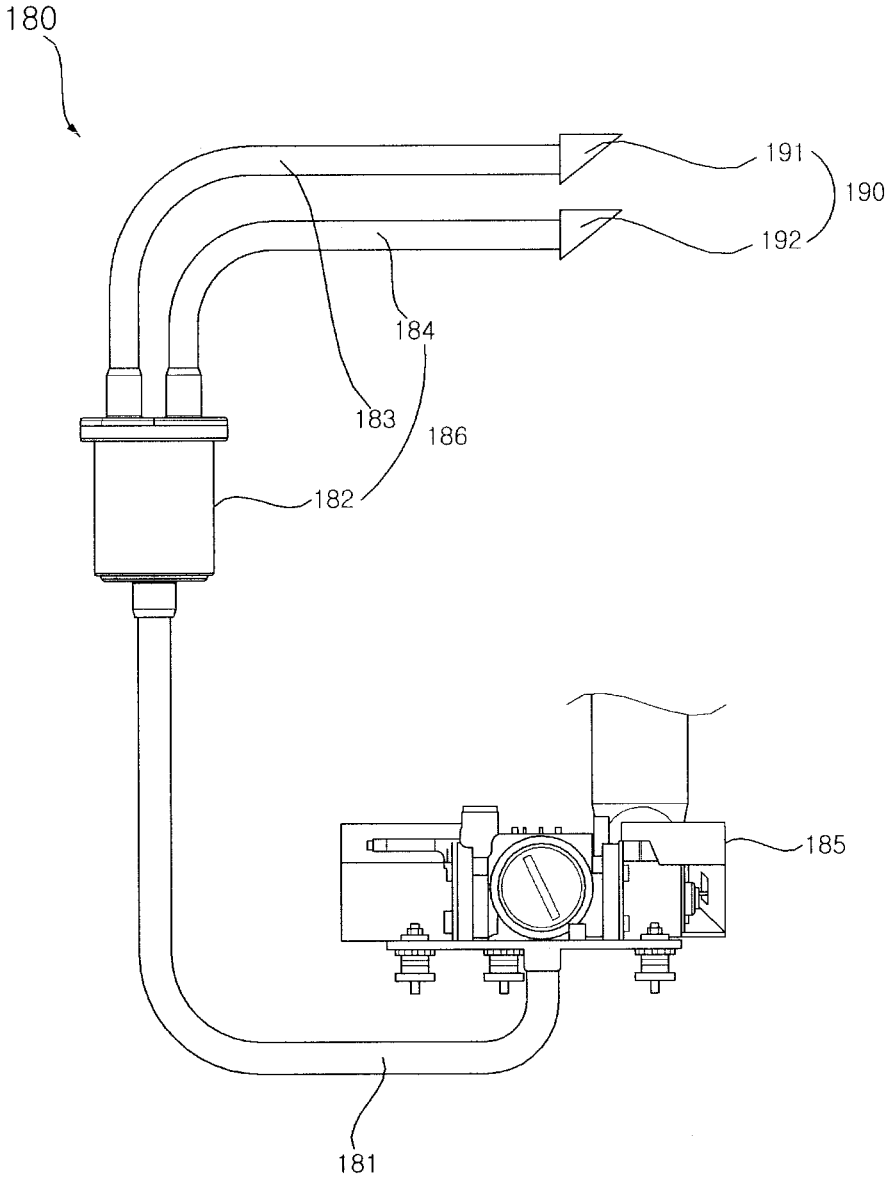
FIG. 5 illustrates an exemplary embodiment of a direction changing unit shown in FIG. 3.
Figure 6:
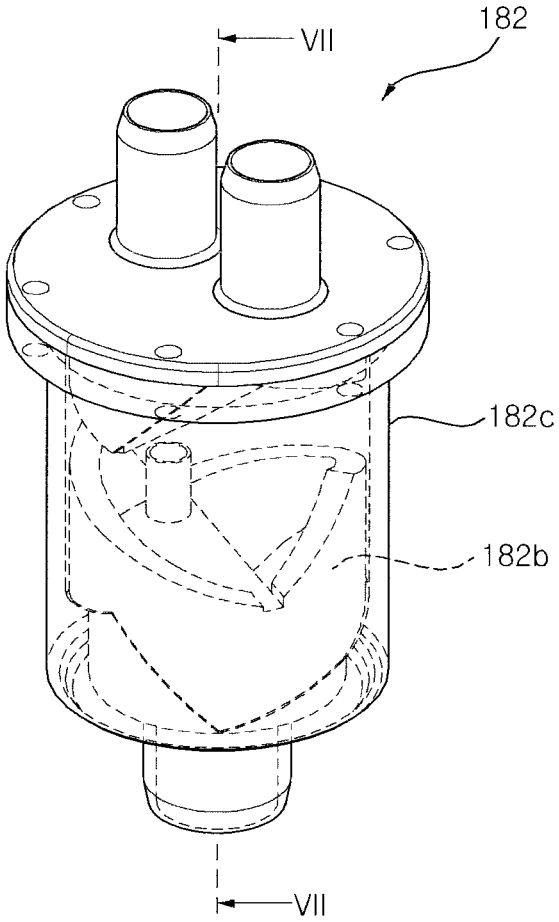
FIG. 6 illustrates an exemplary embodiment of a dispenser shown in FIG. 5.
Figure 7:
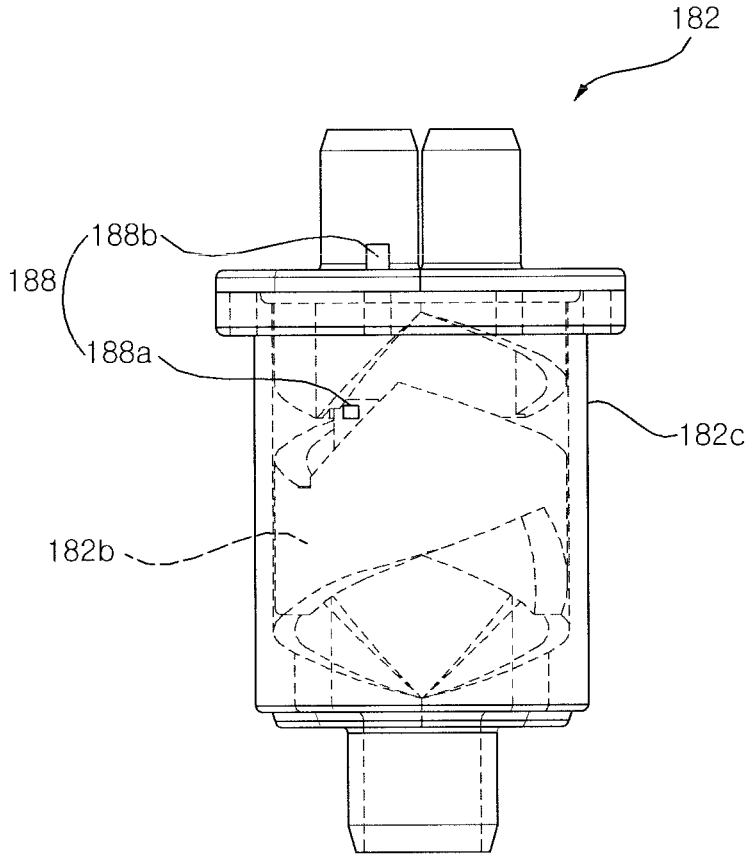
FIG. 7 is a cross-sectional view taken along line VI-VI of FIG. 6.

Referring to FIGS. 5 to 7, the direction changing unit 180 may include a supply path 181 that guides washing fluid from the tub 121, a hydraulic pressure varying unit positioned in the supply path 181 that varies a hydraulic pressure of the washing fluid, and a direction changer 186 positioned between the hydraulic pressure varying unit and the plurality of spray nozzles 190 that varies a spraying direction in which the washing fluid flowing through the supply path 181 is sprayed into the drum 122.

In certain embodiments, the hydraulic pressure varying unit may be a circulation pump 185, as discussed above. However, the hydraulic pressure varying unit is not limited to the circulation pump 185, and may include other devices capable of controlling the hydraulic pressure of the washing fluid flowing in the supply path 181. Simply for ease of explanation, the following description will be made assuming the hydraulic pressure varying unit is a circulation pump 185.

The direction changer 186 may include a dispenser 182 which dispenses washing fluid to the plurality of spray nozzles 190 so as to vary the spraying direction of the washing fluid sprayed into the drum 122. The direction changer 186 may include a plurality of guide passages 183 and 184 that guide the washing fluid from the dispenser 182 to the spray nozzles 190. In particular, the plurality of guide passages 183 and 184 includes a first guide passage 183 coupled to the first spray nozzle 191 and a second guide passage 184 disposed at one side of the first guide passage 183 and coupled to the second spray nozzle 192.

The dispenser 182 may include a body portion 182*c*, and a switch 182*b* disposed inside the body portion 182*c* to selectively open and close the plurality of guide passages 183 and 184. The dispenser 182 may include a position detector 188 for detecting the position of the switch 182*b*. The position detector 188 may include a signal generator 188*a* disposed on the switch 182*b* for generating a signal and a signal detector 188*b* disposed at one side of the body portion 182*c* for detecting the signal generated by the signal generator 188*a*.

In certain embodiments, the signal generator 188*a* may include a magnet that generates a magnetic field and the signal detector 188*b* may include a magnetic detector that detects the magnetic field and a corresponding position of the switch 182*b*. However, the position detector 188 is not limited in this manner and may be formed in various ways. The position detector 188 is a device capable of detecting the position of the switch 182*b*. Also, the signal generator 188*a* and the signal detector 188*b* may be disposed at various positions. For ease of explanation, the following description will be made with respect to a signal detector 188*a* disposed at one side of the body portion 182*c* and a signal generator 188*a* disposed at the switch 182*b*.

Figure 8:
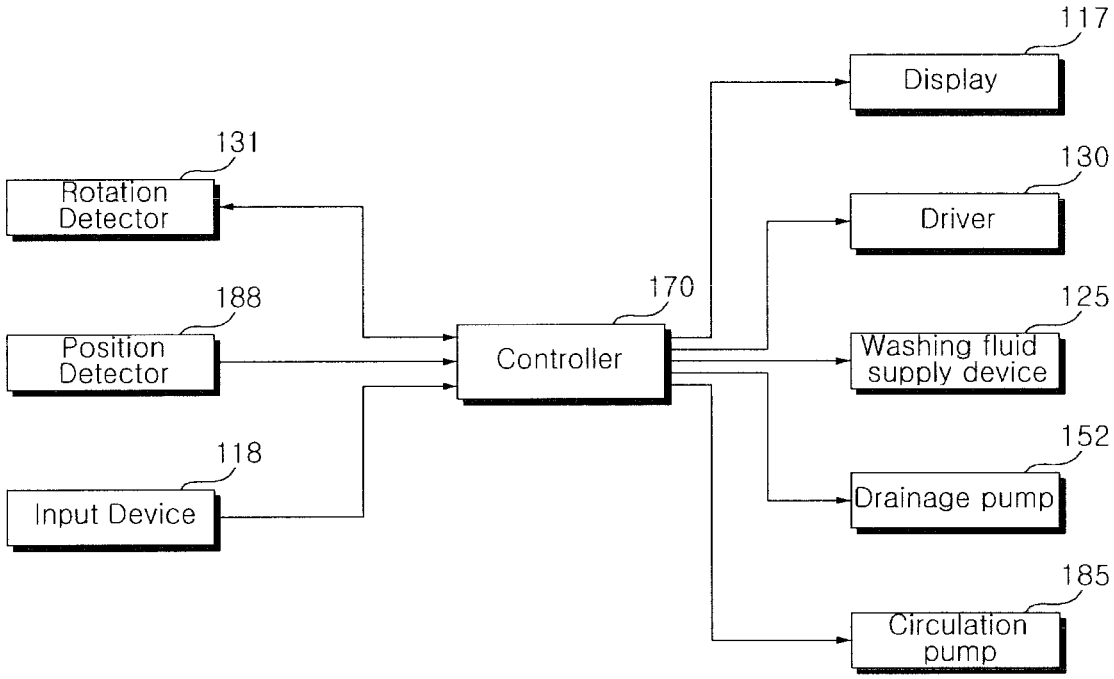
FIG. 8 is a block diagram of an operation and control system of the washing machine shown in FIG. 1.
Figure 9:
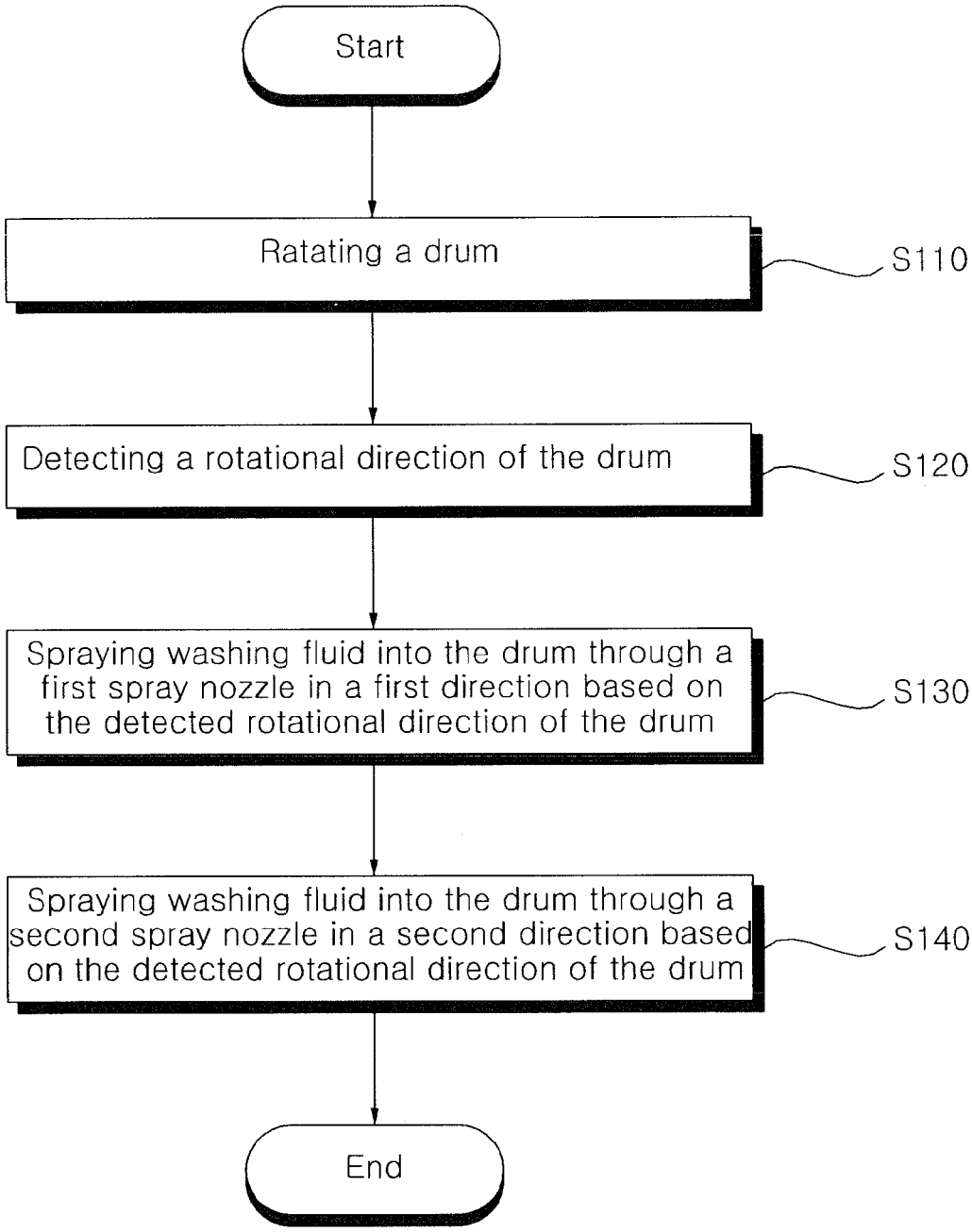
FIG. 9 is a flow chart of a control sequence of the washing machine shown in FIG. 1 as embodied and broadly described herein.

FIG. 8 is a block diagram of a control system of the washing machine 100, and FIG. 9 is a flow chart of an exemplary control sequence of the washing machine 100 shown in FIG. 1.

Referring to FIGS. 8 and 9, washing fluid is introduced into the drum 122 and the tub 122 as operation of the washing machine 100 is started. When the washing fluid in the tub 121 reaches a predetermined level, the drum 122 rotates (S110). Laundry received in the drum 122 rotates along with the rotation of the drum 122. The direction changing unit 180 sprays washing fluid into the drum 122 based on the rotation of the drum 122, and varies the spraying direction of the washing fluid based on the rotating direction of the drum 122 (S120).

In particular, a rotation detector 131 detects the rotating direction of the drum 122 while the drum 122 rotates and the position detector 188 detects the position of the switch 182*b* and transmits this information to a controller 170. The controller 170 controls the switch 182*b* to open and close the first guide passage 183 or the second guide passage 184 based on the detected position of the switch 182*b*.

The signal detector 188*a* may be disposed at various positions of the body portion 182*c*. In certain embodiments, the signal detector 188*a* may be disposed at a portion where the first guide passage 183 and the second guide passage 184 are coupled. For ease of discussion, the following description will be given with respect to a signal detector 188*b* disposed at the portion where the first guide passage 183 and the second guide passage 184 are coupled.

The washing fluid is sprayed into the drum 122 through the first spray nozzle 191 in a first direction based on the detected rotational direction of the drum (S130).

If it is determined that the drum 122 rotates clockwise, the controller 170 determines whether or not the switch 182*b* closes the second guide passage 184. If it is determined that the first guide passage 183 is opened and the second guide passage 184 is closed based on the position of the switch 182*b*, the controller 170 operates the circulation pump 185 to circulate the washing fluid.

When the circulation pump 185 operates, the washing fluid flows through the supply path 181 and is supplied to the first guide passage 183 via the body portion 182*c*. The washing fluid supplied to the first guide passage 183 is sprayed into the drum 122 via the first spray nozzle 191 and onto the laundry items A in the drum 122. Therefore, it is possible to spray the washing fluid accurately onto the laundry in the drum 122 based on the direction of rotation of the drum 122.

As shown in FIGS. 6 and 7, the switch 182*b* may be positioned at a lower portion of the body portion 182*c* due to its weight when the body portion 182*c* is not filled with washing fluid. A signal generated by the signal generator 188*a* when the switch 182*b* moves upward due to the washing fluid in the body portion 182*c* may be detected by the signal detector 188*b*. At least one signal detector 188*b* is disposed at one side of the body portion 182*c* as explained above. However, the signal detector 188*b* is unable to detect a signal if the switch 182*b* remains in the lower portion of the body portion 182*c*. At this time, the controller 170 determines there is no washing fluid in the body portion 182*c* and operates the circulation pump 185.

When the circulation pump 185 operates, the switch 182*b* moves along with the washing fluid in the body portion 182*c*. When the switch 182*b* moves upward within the body portion 182*c*, the signal detector 188*b* detects the position of the switch 182*b* and transmits a signal to the controller 170. When the circulation pump 185 operates and the switch 182*b* closes the second guide passage 184, the signal detector 182*b* does not transmit a signal to the controller 170. On the other hand, when the switch 182*b* closes the first guide passage 183, the signal detector 182*b* transmits a signal to the controller 170. If no signal is transmitted, the controller 170 continuously operates the circulation pump 185. On the other hand, when a signal is transmitted, the controller 170 stops the operation of the circulation pump 185.

When the operation of the circulation pump 185 is stopped, the switch 182*b* moves downward into the lower portion of the body portion 182*c*. After a predetermined time has elapsed, the controller 170 operates the circulation pump 185 again. Once the circulation pump 185 operates, the switch 182*b* positioned in the lower portion of the body portion 182*c* moves upward again.

At this time, the switch 182*b* opens the first guide passage 183 and closes the second guide passage 184.

When the signal detector 188*b* detects that the intensity of the signal emitted from the signal generator 188*a* exceeds a predetermined value, the signal detector 188*b* transmits the signal to the controller 170, and the controller 170 determines that the switch 182*b* has closed the first guide passage 183 based on the signal transmitted from the signal detector 188*b*. If it is determined that the switch 182*b* has closed the first guide passage 183 when the drum 122 rotates clockwise as above, the controller 170 temporarily stops the circulation pump 185. When the circulation pump 185 is stopped, the switch 182*b* moves downward within the body portion 182*c*.

The controller 170 controls operations such that the circulation pump 185 operates again after a predetermined time has elapsed. When the circulation pump 185 operates, the switch 182*b* moves upward within the body portion while rotating. One side of the switch 182*b* is projected to close the portion coupled to the second guide passage 184.

When the switch 182*b* closes the second guide passage 184, the signal detector 188*b* does not transmit a signal to the controller 170 because the signal detector 188*b* is spaced apart by a predetermined distance from the signal generator 188*a*. Therefore, when the drum 122 rotates clockwise by the operation of the circulation pump 185, washing fluid can be accurately sprayed onto the laundry in the drum 122.

When the signal detector 188*b* detects a signal generated by the signal generator 188*a* during the operation of the circulation pump 185, the signal is transmitted to the controller 170. Once the signal is transmitted from the signal detector 188*b* to the controller 170, the controller 170 continues operation of the circulation pump 185. As such, the circulation pump 185 continuously operates, and hence the washing fluid flows through the first guide passage 183 and is sprayed into the drum 122 via the first spray nozzle 191.

The washing fluid is sprayed into the drum 122 through the second spray nozzle 192 in a second direction based on the detected rotational direction of the drum (S140).

When the drum 122 rotates counterclockwise, the washing fluid is controlled so as to flow through the second guide passage 183 in the same or similar manner as described above. That is, when the drum 122 rotates counterclockwise, the rotation detector 131 detects the rotation of the drum 122 and transmits it to the controller 170. The controller 170 determines whether or not the second guide passage 184 is opened based on the position of the switch 182*b* detected from the signal generator 188*a*. The signal detector 188*b* transmits the signal to the controller 170 when the switch 182*b* closes the first guide passage 183.

Based on the transmitted signal, the controller 170 determines whether or not the switch 182*b* closes the second guide passage 184. If it is determined that the switch 182*b* closes the first guide passage 183, the controller 170 continuously operates the circulation pump 185 to circulate the washing fluid through the second guide passage 184. If it is determined that no signal is detected, the controller 170 operates the circulation pump 185. Once the circulation pump 185 operates, the signal detector 188*b* detects a signal.

When a signal is detected, the signal detector 188*b* transmits the signal to the controller 170. The controller 170 determines, based on the signal, that the switch 182*b* closes the first guide passage 183. If it is determined that the switch 182*b* closes the first guide passage 183, the controller 170 continuously operates the circulation pump 185. On the other hand, if the signal is not continuously detected, the controller 170 determines that the switch 182*b* closes the second guide passage 184.

If it is determined that the switch 182*b* closes the second guide passage 184, the controller 170 stops operation of the circulation pump 185. When the circulation pump 185 is temporarily stopped, a hydraulic pressure of the washing fluid in the body portion 182*c* diminishes. Accordingly, the switch 182*b* moves downward within the body portion 182*c*.

After a predetermined time has elapsed, when the controller 170 controls the circulation pump 185 to be operated, the washing fluid flows again to the body portion 182*c*. At this time, the washing fluid applies a hydraulic pressure to the switch 182*b*, so that the switch 182*b* moves upward in the body portion 182*c* while also rotating within the body portion 182*c*.

The switch 182*b* closes the first guide passage 183 and opens the second guide passage 184. Accordingly, when the drum 122 rotates counterclockwise, the second guide passage 184 is opened and the washing fluid is sprayed onto the laundry in the drum 122.

If it is determined that the rotation direction and the spraying direction are different from each other, the output unit outputs a warning message to the user. The warning message may be audible, such as, for example an alarm, a voice, a buzzer, and the like to alert the user. The display 117 may output a visual message, such as, for example, a picture, text, and the like to alert the user. Accordingly, the user is able to easily recognize that the washing fluid is being sprayed in a direction that does not correspond to the rotating direction.

As discussed above, washing fluid flowing through the first guide passage 183 is sprayed into the drum 122 via the first spray nozzle 191, and washing fluid flowing through the second guide passage 184 is sprayed into the drum 122 via the second spray nozzle 192. The first spray nozzle 191 and the second spray nozzle 192 are oriented at a predetermined angle so that first spray nozzle 191 sprays the washing fluid in a first direction into the drum 122, and the second spray nozzle 192 sprays the washing fluid in a second direction into the drum 122 that is different from the first direction. For example, the first spray nozzle 191 sprays the washing fluid onto the laundry in the drum 122 when the drum 122 rotates clockwise and, the second spray nozzle 192 sprays the washing fluid onto the laundry in the drum 122 when the drum 122 rotates counterclockwise.

In addition, the first spray nozzle 191 and the second spray nozzle 192 may be disposed at various positions. For example, the first spray nozzle 191 and the second spray nozzle 192 may be disposed inside the cabinet 110, or may be disposed on the gasket 119 which is disposed between the cover 112 and the tub 121.

The washing machine and associated method described above with reference to FIGS. 1-9 are not limited thereto. The washing machine and associated method shown in FIGS. 1-9 are merely one exemplary implementation and the first spray nozzle 191 and the second spray nozzle 192 may include all devices and methods that spray washing fluid directly into the drum 122 based on a direction of rotation of the drum 122.

For example, in alternative embodiments, a plurality of signal detectors 188*b* may be disposed at one side of the body portion 182*c*. Such a plurality of signal detectors 188*b* may include a first signal detector disposed at a portion where the body portion 182*c* and the first guide passage 183 are coupled and a second signal detector disposed at a portion where the body portion 182*c* and the second guide passage 183 are coupled. When so arranged, washing fluid may be supplied into the drum 122 in the same or similar manner as described above.

When so arranged, when the drum 122 rotates clockwise, the circulation pump 185 operates, and the position detector 188 detects the position of the switch 182*b*. Based on a signal generated by the signal generator 188*a* disposed at the switch 182*b*, the first signal detector or the second signal detector detects the position of the switch 182*b*. When the first signal detector detects the signal of the switch 182*b*, the controller 170 determines that the switch 182*b* closes the first guide passage 183 and controls operation of the circulation pump 185 so that the switch 182*b* closes the second guide passage 184. If it is determined that the switch 182*b* closes the second guide passage 184, the controller 170 continuously operates the circulation pump 185 so that washing fluid is sprayed into the drum 122 via the first guide passage 183 based on the rotation of the drum 122.

When the drum 122 rotates counterclockwise, the position detector 188 detects the position of the switch 182*b*. In particular, the first signal detector or the second signal detector detects the position of the switch 182*b*. When the first signal detector detects a signal, the controller 170 determines that the switch 182*b* closes the first guide passage 183 and continuously operates the circulation pump 185. On the other hand, when the second signal detector detects a signal, the controller 170 determines that the switch 182*b* closes the second guide passage 184 and stops the operation of the circulation pump 185. After a predetermined time has elapsed, the controller 170 operates the circulation pump 185 again, and the switch 182*b* moves/rotates upward within the body portion 182*c*. The switch 182*b* opens the second guide passage 184 and closes the first guide passage 183. Accordingly, when the drum 122 rotates counterclockwise, the washing fluid is sprayed through the second guide passage 184.

In a case in which the switch 182*b* is disposed in the lower portion of the body portion 182*c*, no signal is detected. In this situation, the controller 170 operates the circulation pump 185. The switch 182*b* moves upward within the body portion 182*c* and closes either the first guide passage 182 or the second guide passage 184, and the first signal detector or the second signal detector detects a signal and transmits it to the controller 170.

When the first signal detector detects a signal, the controller 170 determines that the switch 182*b* closes the first guide passage 183 and controls the circulation pump 185 in the same or similar manner as described above. When the second signal detector detects a signal, the controller 170 determines that the switch 182*b* closes the second guide passage 184 and controls the circulation pump 185 in the same or similar manner as described above.

Accordingly, a washing machine and associated method of operation as described above with reference to FIGS. 1-9 spray washing fluid onto the laundry in the drum 122 based on the rotating direction of the drum 122. Since the washing fluid is sprayed onto laundry items that are spread out along the circumference of the drum 122 (due to the rotation of the drum 122), the washing fluid may be rapidly supplied to the laundry.

Figure 10:
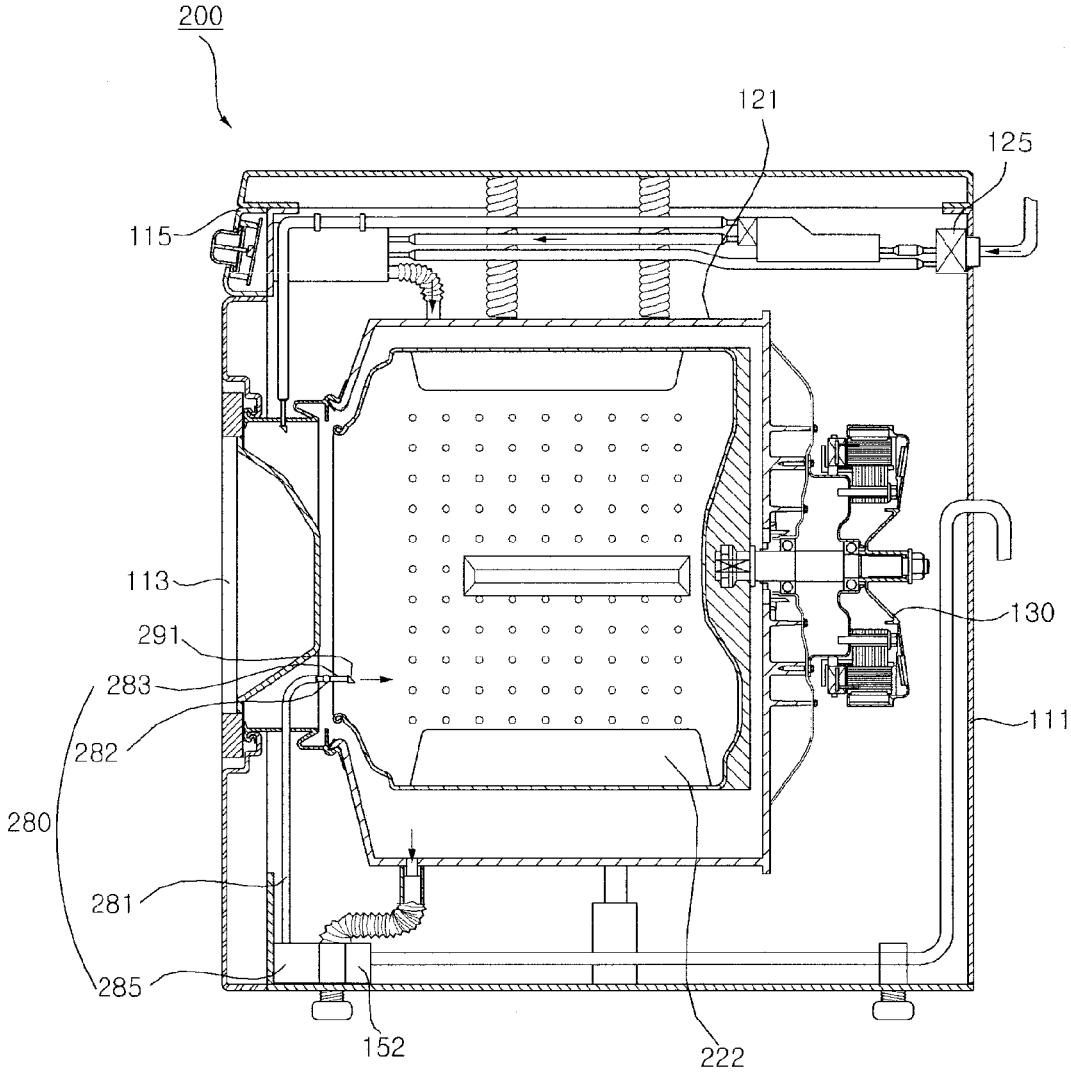
FIG. 10 is a cross-sectional view of an exemplary washing machine in which washing fluid is circulated and sprayed, in accordance with another embodiment as broadly described herein.
Figure 11A:
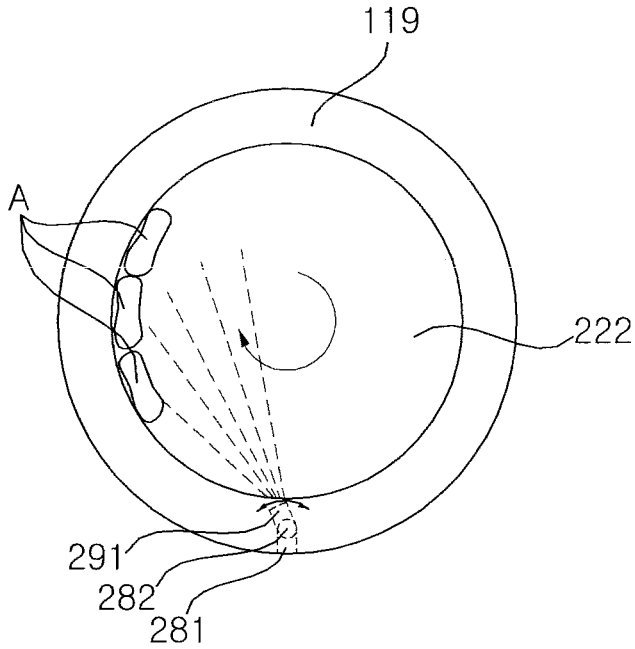
FIG. 11A illustrates the spray direction of washing fluid during clockwise rotation of the drum shown in FIG. 10.
Figure 11B:
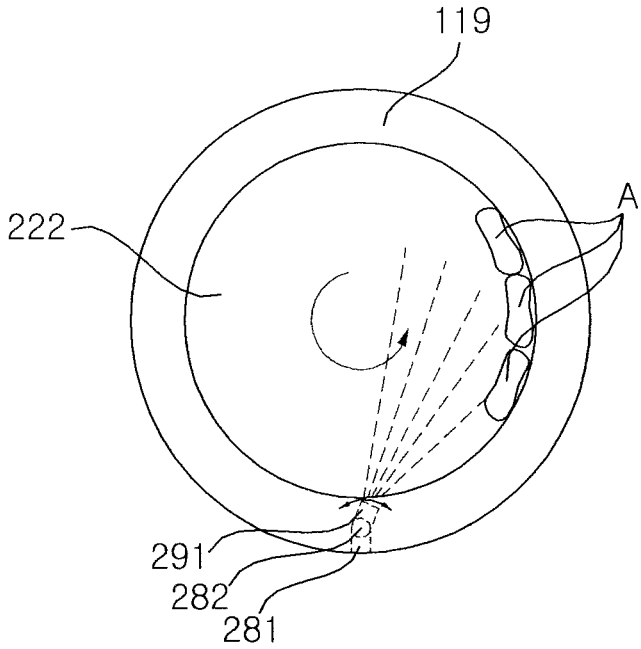
FIG. 11B illustrates the spray direction of washing fluid during counterclockwise rotation of the drum shown in FIG. 10.
Figure 12:
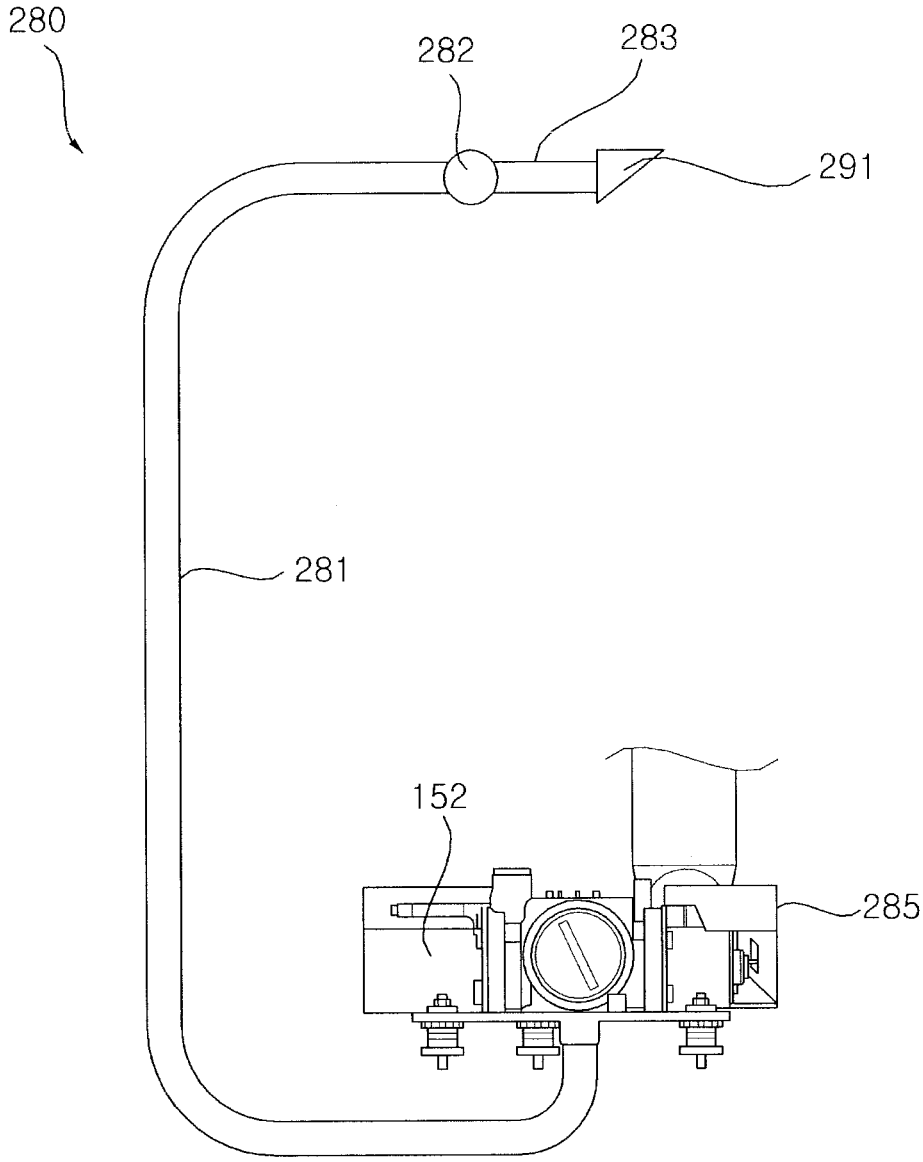
FIG. 12 illustrates a direction changing unit shown in FIG. 10.

FIG. 10 is a cross-sectional view of a washing machine in accordance with another embodiment as broadly described herein, FIG. 11 illustrates a spray direction of washing fluid into a drum 222 shown in FIG. 10, and FIG. 12 illustrates a direction changing unit 280 of the washing machine shown in FIG. 10. In the following, the same reference numerals as those described above will indicate the same elements wherever possible.

Referring to FIGS. 10 and 12, a washing machine 200 in accordance with another embodiment as broadly described herein may include direction changing unit 280 that varies the direction in which washing fluid is sprayed into the drum 222 based on the rotation of the drum 222. Therefore, the washing fluid may be accurately sprayed onto laundry items in the drum 222 in accordance with the rotation of the drum 222.

The direction changing unit 280 may include a start-up motor 282 positioned at one side of a spray nozzle 291 to change an orientation direction of the spray nozzle 291.

The direction changing unit 280 may also include a supply path 281 for guiding washing fluid from the tub 121, and a hydraulic pressure varying unit 285 disposed in the supply path 281 for varying a hydraulic pressure of the washing fluid. The start-up motor 282 may change the spraying direction of the spray nozzle 291 based on variance in hydraulic pressure. In certain embodiments, the hydraulic pressure varying unit 285 may include a circulation pump 285. The direction changing unit 280 may also include a passage 283 that supplies washing fluid to the nozzle 291

When the drum 222 rotates as described above, the circulation pump 285 operates to circulate the washing fluid, and the rotation detector 131 detects the rotation of the drum 222. Based on the detected rotation, the controller 170 controls the start-up motor 282 so as to spray the washing fluid onto the laundry in the drum 222 in a desired direction.

Referring to FIG. 11A, when the drum 222 rotates in a clockwise direction, the controller 170 actuates the start-up motor 282 such that the spray nozzle 291 is positioned in a first direction. Referring to FIG. 11B, when the drum 222 rotates in a counterclockwise direction, the controller 170 controls the start-up motor 282 such that the spray nozzle 291 is positioned in a second direction that is different from the first direction.

The spray nozzle 291 sprays the washing fluid onto the laundry items A in the drum 222 based on a direction of rotation of the drum 222. Accordingly, the washing fluid may be accurately sprayed onto the laundry items A in accordance with the rotation of the drum 222. Moreover, because the washing fluid is rapidly supplied to the laundry, washing performance may be improved and washing time may be shortened.

Figure 13:
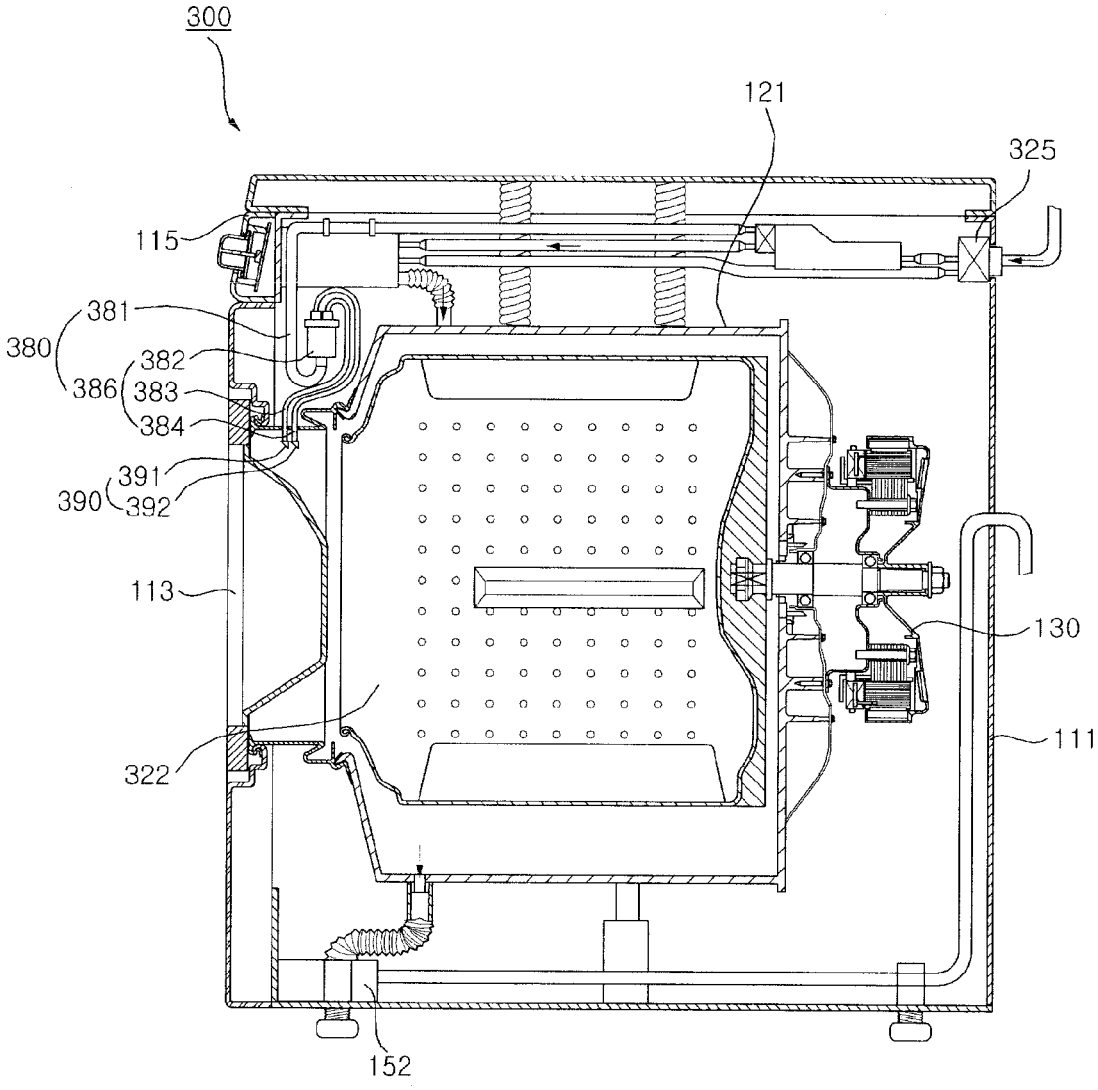
FIG. 13 is a cross-sectional view of a washing machine in which washing fluid is circulated and sprayed in accordance with an embodiment as broadly described herein.
Figure 14A:
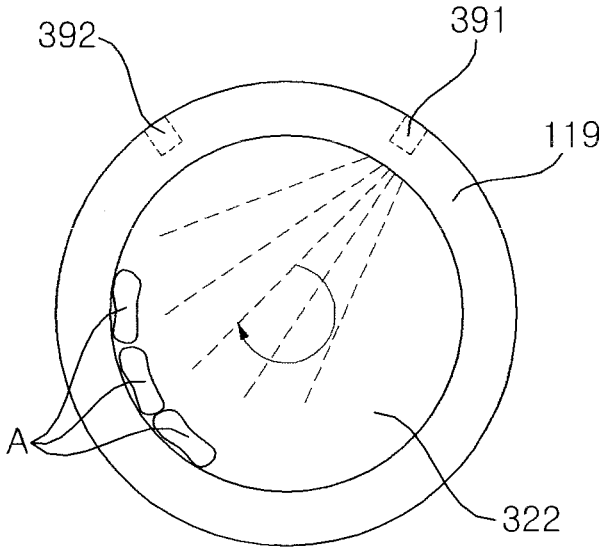
FIG. 14A illustrates the spray direction of washing fluid during clockwise rotation of the drum shown in FIG. 13.
Figure 14B:
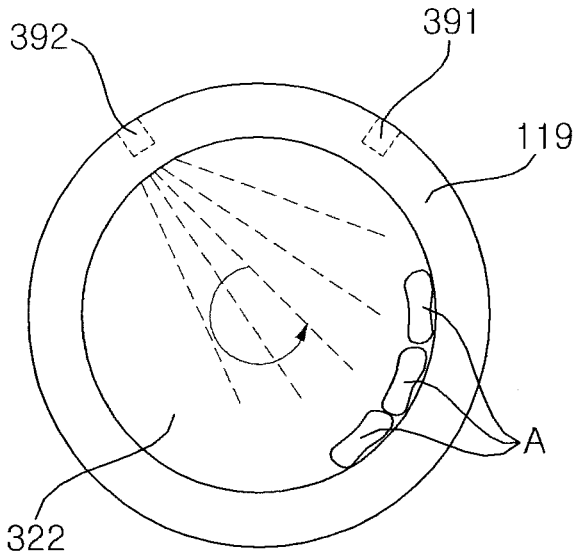
FIG. 14B illustrates the spray direction of washing fluid during counterclockwise rotation of the drum shown in FIG. 13.
Figure 15:
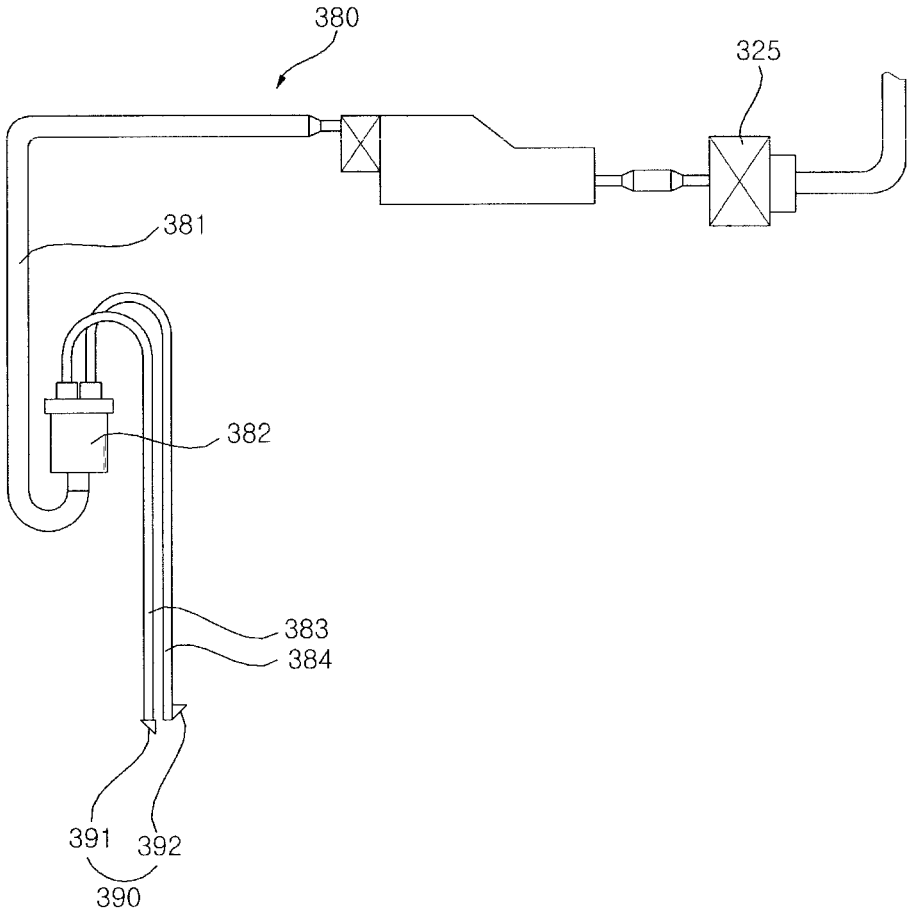
FIG. 15 illustrates a direction changing unit shown in FIG. 13.

FIG. 13 is a cross-sectional view of a washing machine in accordance with another embodiment as broadly described herein, FIG. 14 illustrates a spray direction of washing fluid into a drum 322 shown in FIG. 13, and FIG. 15 illustrates a direction changing unit 380 of the washing machine shown in FIG. 13. In the following, the same reference numerals as those described above will indicate the same elements wherever possible.

Referring to FIGS. 13 and 15, a washing machine 300 in accordance with another embodiment as broadly described herein may include direction changing unit 380 that varies a spraying direction of washing fluid sprayed into the drum 322 by a plurality of spraying nozzles 390. The direction changing unit 380 may include a supply path 381 for supplying washing fluid, or fluid supply device 325 for controlling a hydraulic pressure of the washing fluid in the supply path 381, and a direction changer 386 for varying the direction in which washing fluid is sprayed into the drum 322.

The fluid supply device 325 may include, for example, a pump and a solenoid valve for controlling flow in the supply path 381.

The direction changing unit 386 may include a dispenser 382 that dispenses the washing fluid to a plurality of guide passages 383 and 384. The dispenser 382 may include a body portion (not shown in FIGS. 13-15) and a switch (not shown in FIGS. 13-15) disposed inside the body portion, for selectively opening and closing the plurality of guide passages 383 and 384.

When the washing machine 300 operates, washing fluid is introduced and the dispenser 382 dispenses the washing fluid to the first guide passage 383 or the second guide passage 384 using hydraulic pressure as described above.

The washing fluid supply device 325 varies the hydraulic pressure of the washing fluid flowing through the supply path 381. If the washing fluid supply device 325 includes a pump, the controller 170 controls the hydraulic pressure of the washing fluid by operating the pump. For example, the controller 170 can control the hydraulic pressure of the washing fluid by applying electric current to a solenoid valve for a predetermined time.

Referring to FIG. 14, the controller 170 controls the washing fluid supply device 325 in accordance with a rotating direction of the drum 322 in a substantially or similar manner as described with respect to FIGS. 5 to 9, on the basis of the rotating direction of the drum 322. As shown in FIG. 14A, when the drum 322 rotates clockwise, washing fluid is sprayed via a first spray nozzle 291. As shown in FIG. 14B, when the drum 322 rotates counterclockwise, the washing fluid is sprayed via a second spray nozzle 392.

Accordingly, the washing machine 100 is able to spray the washing fluid based on a direction of rotation of the drum 322. Since the washing fluid is sprayed in accordance with the rotation of the drum 322, the washing fluid may be supplied accurately and rapidly onto the laundry.

If the rotation direction and the spraying direction are different from each other, the output unit may output a warning message to the user. The output unit may output an audible warning message, such as, for example, an alarm, a voice, a buzzer, and the like to alert the user. The display 117 may output a visual warning message, such as, for example, a picture, text, and the like to alert the user. Accordingly, the user is able to easily recognize that the washing fluid is being sprayed in a direction that does not correspond to the rotating direction.

Figure 16:
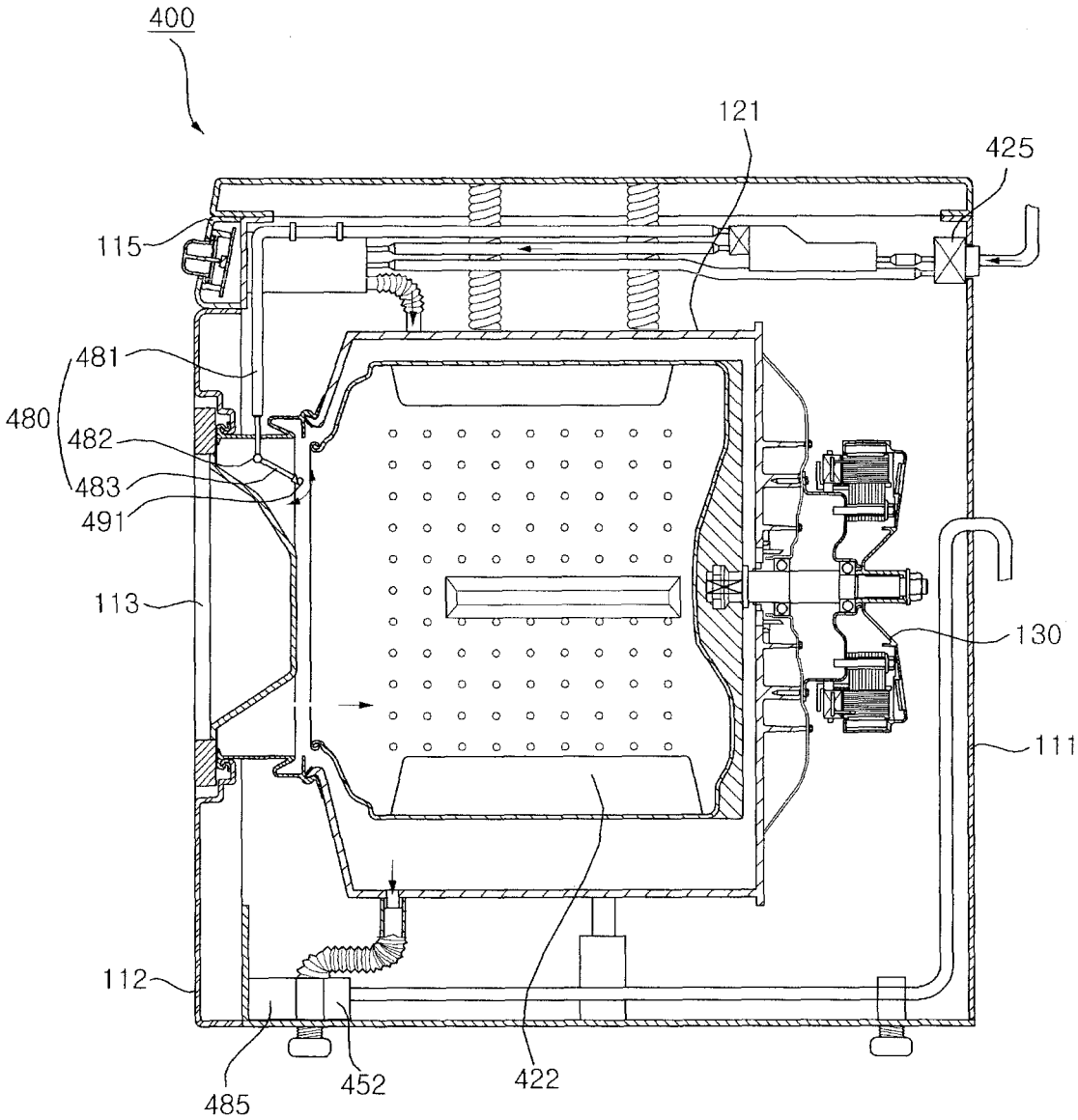
FIG. 16 is a cross-sectional view of a washing fluid of the washing machine in which washing fluid is circulated and sprayed, in accordance with another embodiment as broadly described herein.
Figure 17A:
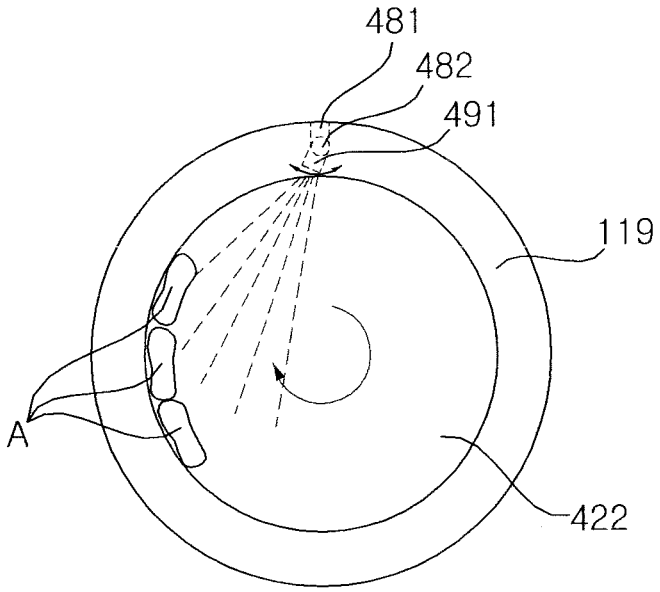
FIG. 17A illustrates the spray direction of washing fluid during clockwise rotation of the drum shown in FIG. 16.
Figure 17B:
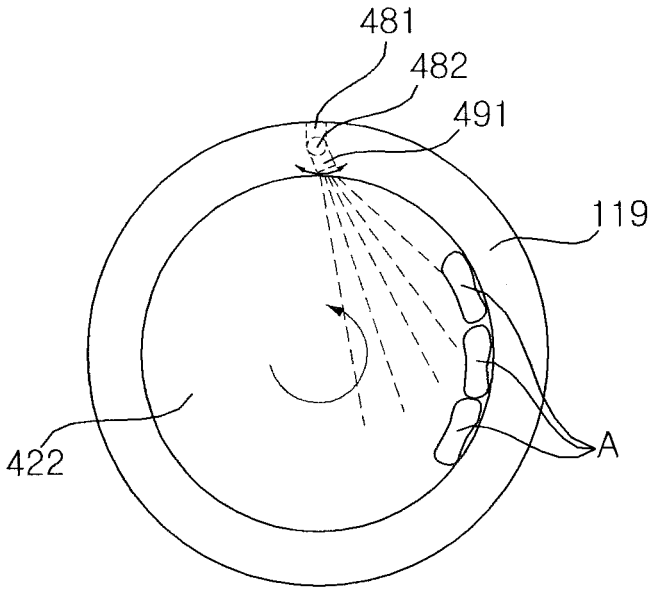
FIG. 17B illustrates the spray direction of washing fluid during counterclockwise rotation of the drum shown in FIG. 16.
Figure 18:
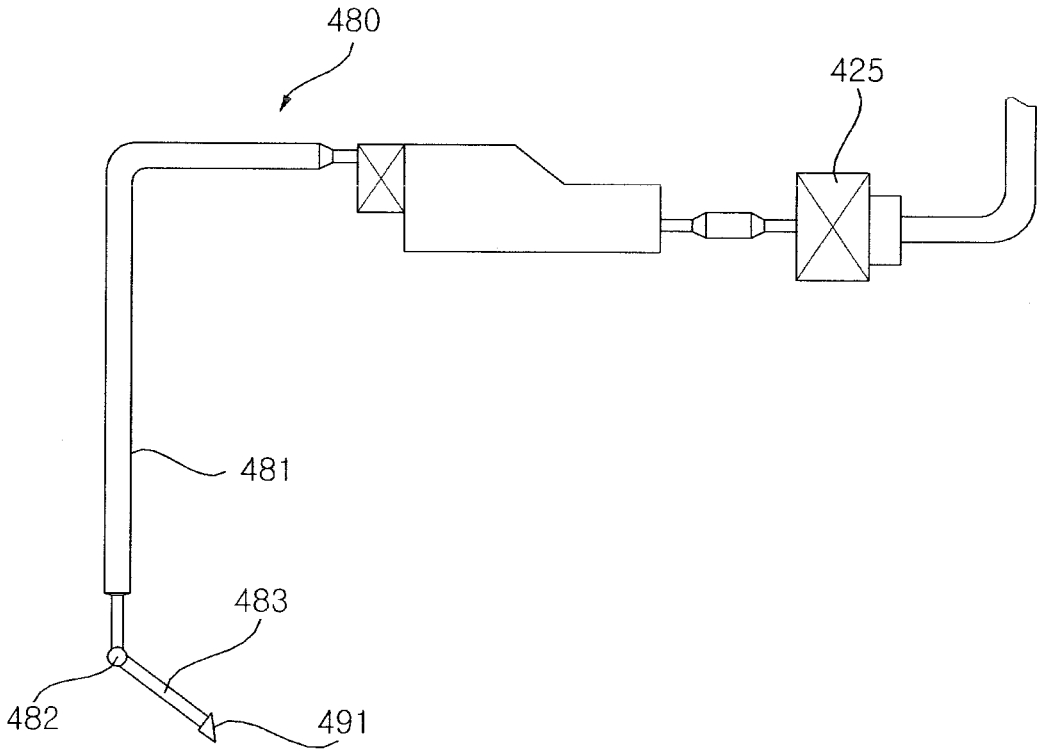
FIG. 18 illustrates a direction changing unit shown in FIG. 16, in accordance with another embodiment as broadly descried herein.

FIG. 16 is a cross-sectional view of a washing machine in accordance with another embodiment as broadly described herein, FIG. 17 illustrates a spray direction of washing fluid into a drum 422 shown in FIG. 16, and FIG. 18 illustrates a direction changing unit 480 of the washing machine shown in FIG. 16. In the following description, the same reference numerals as those described above will indicate the same elements wherever possible.

Referring to FIGS. 16 and 18, a washing machine 400 in accordance with another embodiment as broadly described herein may include a direction changing unit 480 that sprays washing fluid onto laundry items A in the drum 422 based on a rotation direction of the drum 422.

The direction changing unit 480 may include a supply path 481 and a washing fluid supply device 425 for controlling the washing fluid in the supply path 481. The direction changing unit 480 may also include a start-up motor 482 disposed at one side of a spray nozzle 491 to vary the orientation direction of the spray nozzle 491. The direction changing unit 480 may also include a guide passage 483 that guides fluid to the nozzle 491.

When the washing machine 400 operates, washing fluid is supplied, and the rotation detector 131 detects the rotation of the drum 422 and transmits it to the controller 170. The controller 170 controls the start-up motor 482 on the basis of the rotation of the drum 422.

The start-up motor 482 varies the direction of the spray nozzle 491 based on the direction of rotation of the drum 422 so as to spray the washing fluid onto the laundry items A in the drum 422. As shown in FIG. 17A, when the drum 422 rotates clockwise, the spray nozzle 491 sprays washing fluid in a first direction so that washing fluid may be accurately sprayed on the laundry items A in the drum 422. As shown in FIG. 17B, when the drum 422 rotates counterclockwise, the spray nozzle 491 sprays washing fluid in a second direction that is different from the first direction shown in FIG. 17A so that washing fluid may be accurately sprayed on the laundry items A in the drum 422.

When the drum 422 rotates, the controller 170 controls the start-up motor 491 in the same or similar manner as described with respect to FIGS. 10 to 12. Accordingly, the washing fluid spraying direction of the spray nozzle 291 is varied depending on the rotation direction of the drum 422, and washing fluid is accurately and rapidly sprayed onto the laundry items A in the drum 422.

Figure 19:
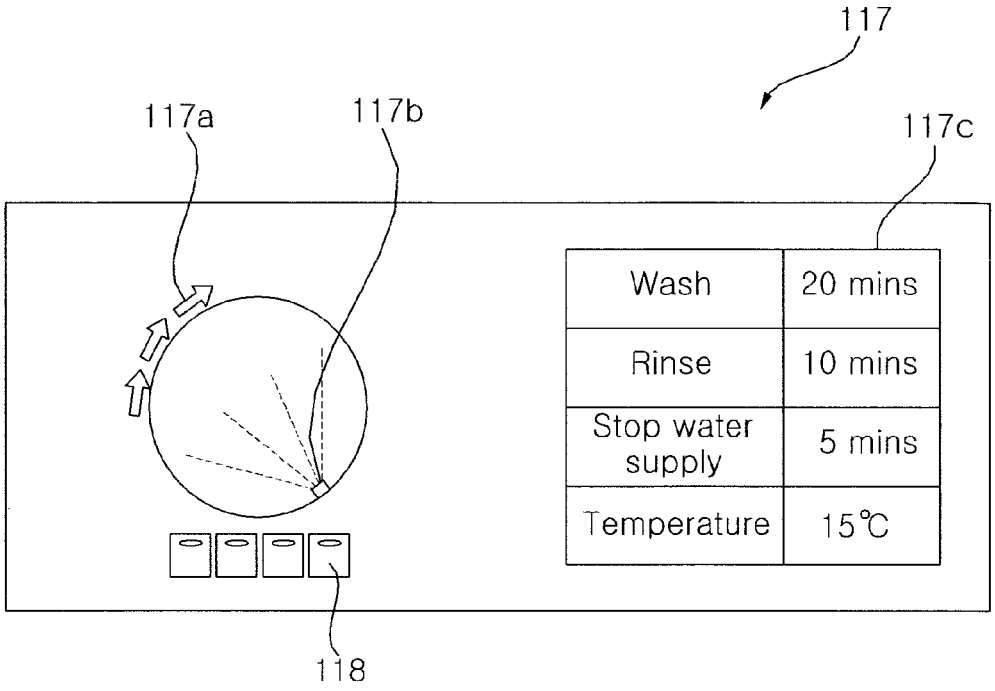
FIG. 19 illustrates an exemplary display in accordance with an embodiment as broadly described herein.

FIG. 19 is an exemplary illustration of the display 117 shown in FIG. 1. A user may input an external signal or command through an input unit 118 so as to control the circulation pump 185. When the external signal is input, washing fluid is sprayed into the drum 122 in the same or similar manner as described above. Using the input unit 118, the user may control the washing machine such that the washing fluid is sprayed according to a motion of the drum 122. That is, the user can input the external signal through the input unit 118 such that the washing fluid is sprayed differently according to whether the drum 122 rapidly rotates once or reciprocates. The method of controlling washing fluid is carried out in the same or similar manner as described above.

When a user inputs the external signal to spray the washing fluid towards one side of the drum 122, the display 117 displays a motion of the drum 122 and a washing fluid spray model. More specifically, the drum 122 carries out its motion in various directions according a particular cycle being performed. While the motion is being performed, the display 117 displays the motion of the drum 122 through a motion display portion 117*a* corresponding to the motion. The motion may be displayed as, for example, a rotating direction, a rotational speed, and so on.

A washing fluid spray display portion 117*b* for showing a direction of spraying washing fluid the drum 122 is displayed on one side of the motion display portion 117*a*. That is, as explained above, the washing fluid spraying direction, depending on the rotating direction of the drum 122, is displayed on the display 117 according to the external signal input by the user. Accordingly, the user can easily check the washing fluid spraying direction depending on the rotation of the drum 122 and the motion of the drum 122.

A washing machine and washing method as embodied and broadly described herein may improve washing performance by spraying washing water onto laundry.

A washing machine as embodied and broadly described herein may include a cabinet having an opening; a drum receiving laundry; and a spray nozzle disposed inside the cabinet to spray washing water into the drum.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine, comprising:

a tub installed in a cabinet, each having an opening formed therein;

a drum rotatably installed in the tub and configured to receive laundry items therein through the opening in the cabinet and the tub;

a gasket coupled to the opening in the cabinet and the tub;

a fluid supply device for supplying washing fluid from an external source;

at least one spray nozzle coupled to a portion of the gasket for spraying washing fluid supplied from the fluid supply device into the drum; and a direction changer coupled to the at least one spray nozzle and varying a direction of washing fluid sprayed from the at least one spray nozzle.

2. The washing machine of claim 1, wherein the direction changer varies the direction of washing fluid sprayed into the drum based on a direction of rotation of the drum.

3. The washing machine of claim 1, further comprising a supply path for guiding washing fluid from the fluid supply device to the at least one spray nozzle.

4. The washing machine of claim 1, wherein the at least one spray nozzle comprises a plurality of spray nozzles, and wherein the direction changer comprises:

a dispenser that dispenses washing fluid to the plurality of spray nozzles so as to vary the spraying direction of washing fluid sprayed into the drum; and a plurality of guide passages for respectively guiding washing fluid dispensed from the dispenser to the plurality of spray nozzles.

5. The washing machine of claim 4, wherein each of the plurality of spray nozzles sprays washing fluid into the drum in a different direction corresponding to a direction of rotation of the drum.

6. The washing machine of claim 4, wherein the plurality of spray nozzles comprises a first spray nozzle that sprays washing fluid into the drum in a first spray direction when the drum rotates in a first rotational direction, and a second spray nozzle that sprays washing fluid into the drum in a second spray direction when the drum rotates in a second rotational direction.

7. The washing machine of claim 6, wherein the first spray nozzle and the second spray nozzle are each oriented at a respective predetermined angle.

8. The washing machine of claim 1, further comprising a circulation pump that circulates washing fluid from the tub.

9. The washing machine of claim 1, wherein the at least one spray nozzle is coupled to an upper portion of the gasket.

10. The washing machine of claim 1, wherein the at least one spray nozzle is coupled to a lower portion of the gasket.

11. The washing machine of claim 1, wherein the at least one spray nozzle sprays washing into the drum during a washing cycle or a rinsing cycle.

* * * * *